US005248243A

United States Patent [19]

Dyer et al.

[11] Patent Number: 5,248,243

[45] Date of Patent: Sep. 28, 1993

[54] PNEUMATICALLY OPERATED AND CONTROLLED FLUID PUMP

[75] Inventors: Richard Dyer, Taft; Fred Davis, Visalia; Mark Hill, Hanford; Ozell Purswell, Bakersfield, all of Calif.

[73] Assignee: World Pump Corporation, Minneapolis, Minn.

[21] Appl. No.: 824,832

[22] Filed: Jan. 22, 1992

[51] Int. Cl.[5] ..... F04B 47/04

[52] U.S. Cl. ..... 417/137; 417/145

[58] Field of Search ..... 417/137, 138, 139, 140, 417/141, 142, 143, 144, 145, 147, 401

[56] References Cited

U.S. PATENT DOCUMENTS

| | | | |
|---|---|---|---|
| 385,014 | 6/1888 | Simpkin | 417/138 |
| 1,456,885 | 5/1923 | Gardner | 417/143 |
| 1,758,921 | 5/1930 | Bayles . | |
| 1,854,580 | 4/1932 | Crockett . | |
| 1,962,473 | 6/1934 | Atwell et al. . | |
| 2,206,447 | 7/1940 | Berry . | |
| 2,360,038 | 10/1944 | Burton . | |
| 3,288,081 | 11/1966 | McMillan et al. | 417/147 |
| 3,552,884 | 7/1968 | Faldi . | |
| 3,647,319 | 3/1972 | McLean et al. . | |
| 3,676,019 | 7/1972 | Self . | |
| 4,305,700 | 12/1981 | Beard . | |
| 4,990,061 | 2/1991 | Fowler | 417/137 |

*Primary Examiner*—Richard A. Bertsch
*Assistant Examiner*—Roland McAndrews
*Attorney, Agent, or Firm*—Fredrikson & Byron

[57] ABSTRACT

A pneumatically operated and controlled pump which is capable of maintaining its efficiency and reliability in various environments. The pump head contains a spool and sleeve valve assembly operated in response to a signal pressure. The assembly controls the cycling of the pump through a pumping phase and a pump filling phase. A timing switch on the surface controls the occurrence of the signal pressure and thus the pump cycles, at preset intervals thus eliminating any lag time between the cycles and the need for operator estimations of the cycle times. This results in a virtually closed system and self contained unit.

2 Claims, 11 Drawing Sheets

26
12
14
37
29
32
28
36
35
35
30
34
33
24
22
20
22
16

26
12
14
37
29
32
36
28
30
35
35
33
34
24
22
20
22
16

PNEUMATICALLY OPERATED AND CONTROLLED FLUID PUMP

FIELD OF THE INVENTION

The present invention relates to pneumatic pumps for pumping fluids such as oil and water as well as solids that may be suspended in such fluids.

BACKGROUND OF THE INVENTION

Pneumatically powered pumps for pumping fluids have found applications in a variety of environments. Such pumps have commonly been utilized for pumping water for agricultural and residential uses, and less frequently, for pumping petroleum from beneath the earth's surface. Basic pneumatic pumps typically expel the fluid that has entered the pump's chamber by sending compressed gas from the surface down an intake tube to the chamber. The gas exerts pressure upon the fluid causing it to exit the chamber through an outlet tube and rise to the earth's surface. The gas is then exhausted from the pump chamber through an exhaust tube, the chamber is allowed to refill with the fluid and the cycle is repeated. While this system works, it is subject to some major hindrances. The compressor and other necessary equipment necessary for operating the pump is located at the surface. The entire length of the intake tube, therefore, must be filled with compressed gas before the gas exerts sufficient pressure upon the fluid so that the fluid will begin to exit the pump chamber. For deeper wells requiring expansive tube lengths, large lag times ca be created while the intake tube fills with gas. Even when the pump is at a shallower depth, the constant need to refill the intake tube before the fluid is pumped creates an inefficient method of operation. Furthermore, it is frequently difficult for the pump operator to determine the time of the cycle between the intake and exhaust strokes of the pump.

Numerous other drawbacks exist with prior pneumatic pumps. The equipment necessary to operate the pumps results in a large surface profile for the pumps. Furthermore, many pumps are unsuited for anything but ideal environmental conditions or for pumping the solids that commonly are suspended within the fluids and thus require expensive and frequent maintenance.

A need exists, therefore, for an efficient pneumatic pump capable of reliably pumping fluids in a variety of environments.

SUMMARY OF INVENTION

The application discloses an efficient and reliable submersible pneumatically operated and controlled pump. Constant intake pressure is maintained at the pump head allowing the pump to maintain its efficiency even at extreme depths. A spool and sleeve valve assembly, operated in response to a signal pressure, controls the cycling of the pump. The spool and sleeve valve assembly is located within the pump head. In one embodiment, the spool valve rests upon a spring. While in this position, the spool valve blocks the flow of the high pressure gas into the pump chamber and instead exposes an exhaust vent allowing any gas within the pump chamber to vent to the surface and further allowing the fluid to enter the chamber. When the signal pressure is activated, compressed gas acts upon the spool valve forcing it down upon and compressing the spring. In this position, the exhaust vent is blocked and the high pressure air is allowed to enter the chamber where it forces the fluid out of the pump chamber and up to the surface.

In an alternate embodiment, no spring is used with the spool valve. Instead, two signal pressures, one at the top and one at the bottom of the spool valve, work to slide the spool valve between its exhaust and power positions.

In both embodiments, a timing switch on the surface controls the occurrence of the signal pressure and thus the pump cycles, at preset intervals. This eliminates any lag time between cycles and the need for operator estimations of the cycle times. The pump is, therefore, virtually a closed system and self-contained unit.

The pump is fully submersible and can pump a great variety of fluids in a number of diverse environments. Many of the fluids desired to be pumped exist in conditions not conducive to pumping. The pump of the present invention, however, is able to pump most solids that may be suspended within the fluid. The inner cylinder of the pump up which the fluid travels can also be open-ended. This configuration allows for the pumping of larger solid objects which may exist in conjunction with the fluid.

DETAILED DESCRIPTION OF THE INVENTION

Figure 1:
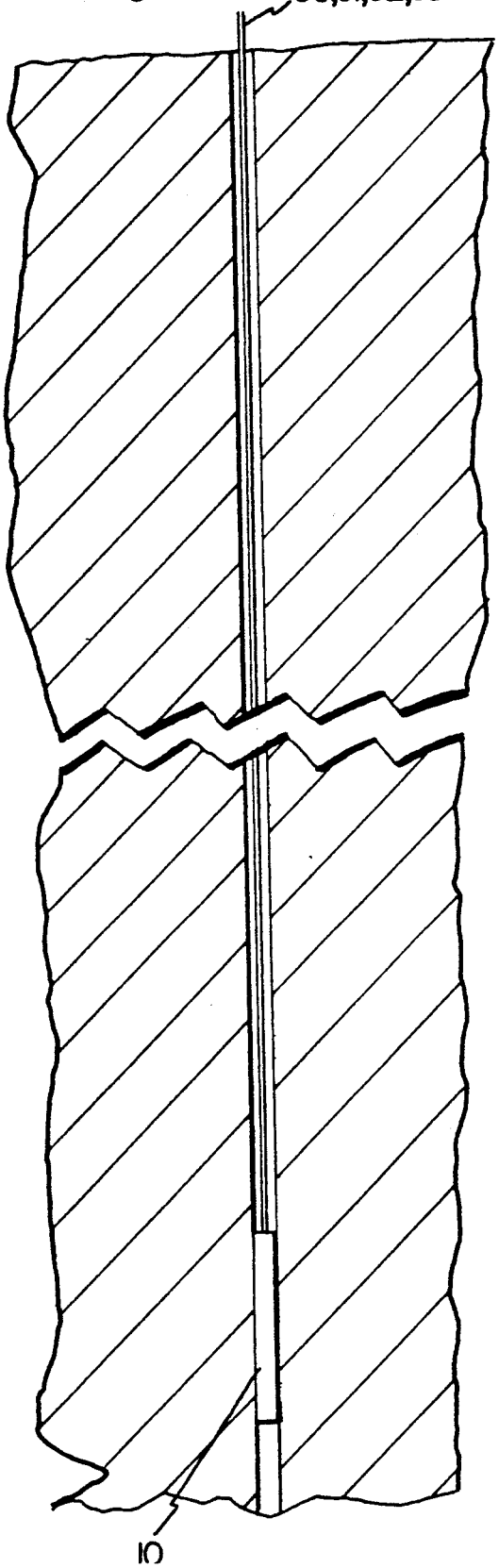
FIG. 1 is a cross-sectional view showing the pump located within a well.
Figure 2:
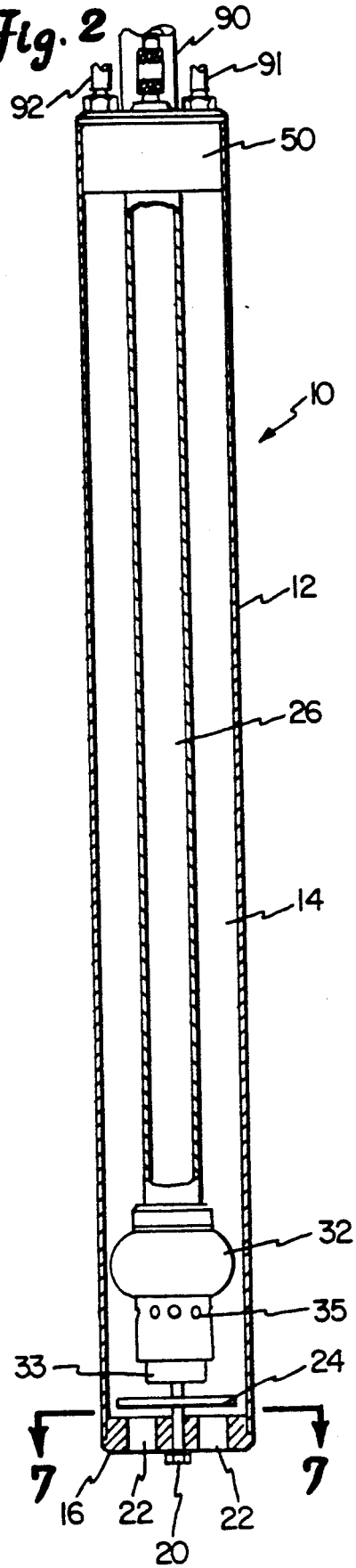
FIG. 2 is a cross-sectional view of the pump cylinder.
Figure 3A:
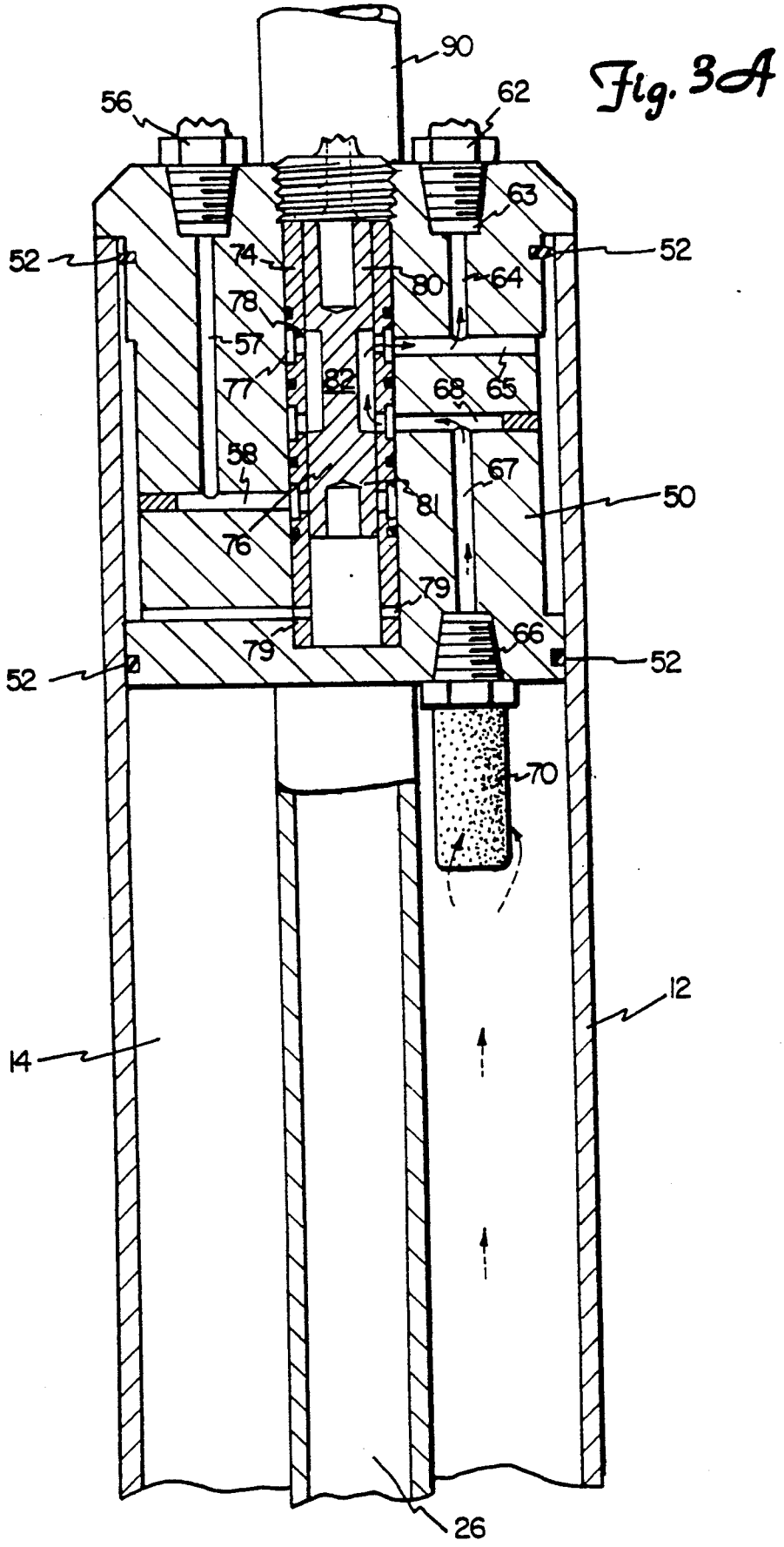
FIG. 3A is a cut-away view of the head and upper portion of the pump cylinder showing the pump in the exhaust phase.
Figure 3B:
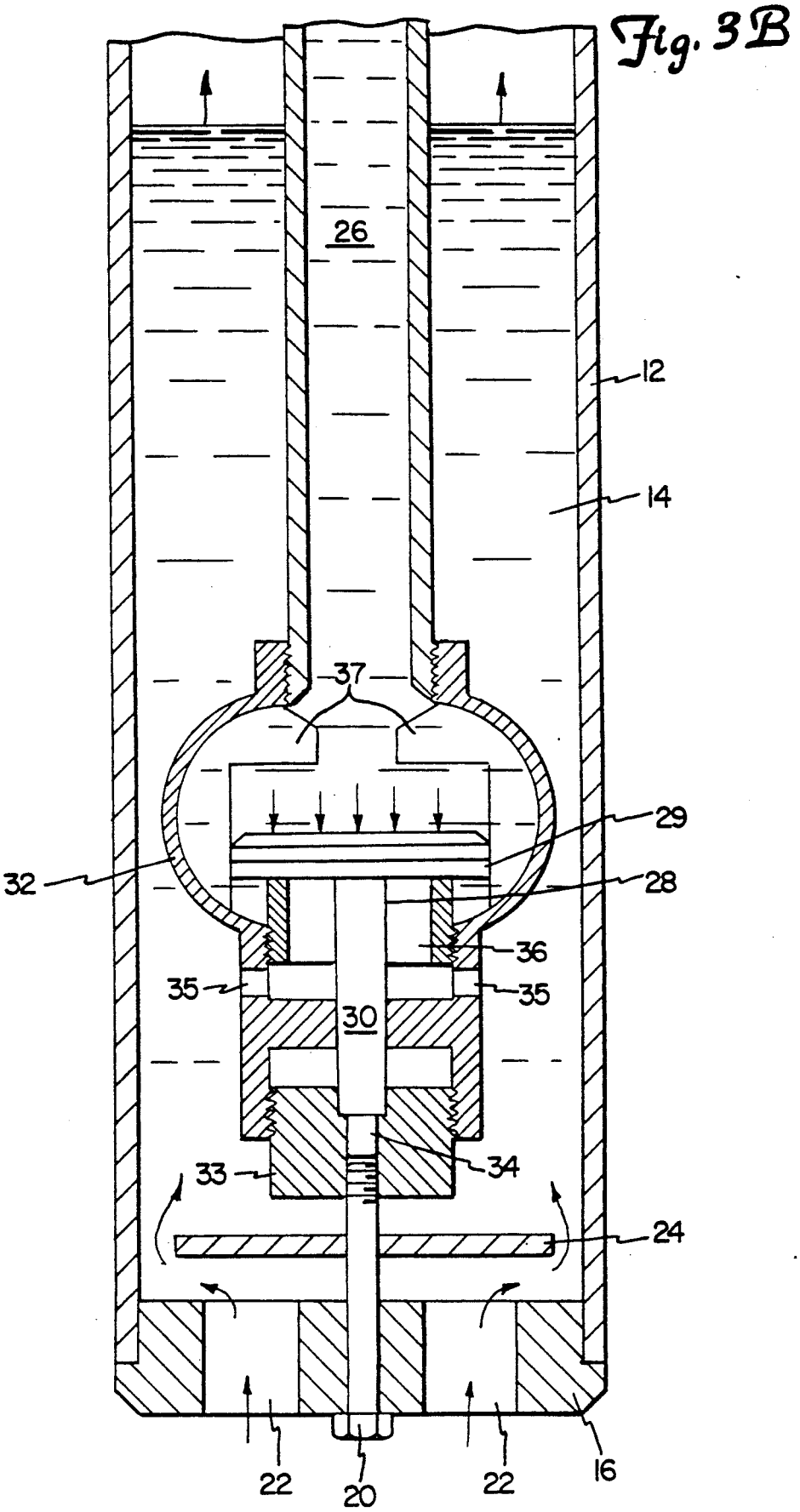
FIG. 3B is a cross-sectional view of the lower portion of the pump cylinder showing the pump in the exhaust phase.
Figure 4A:
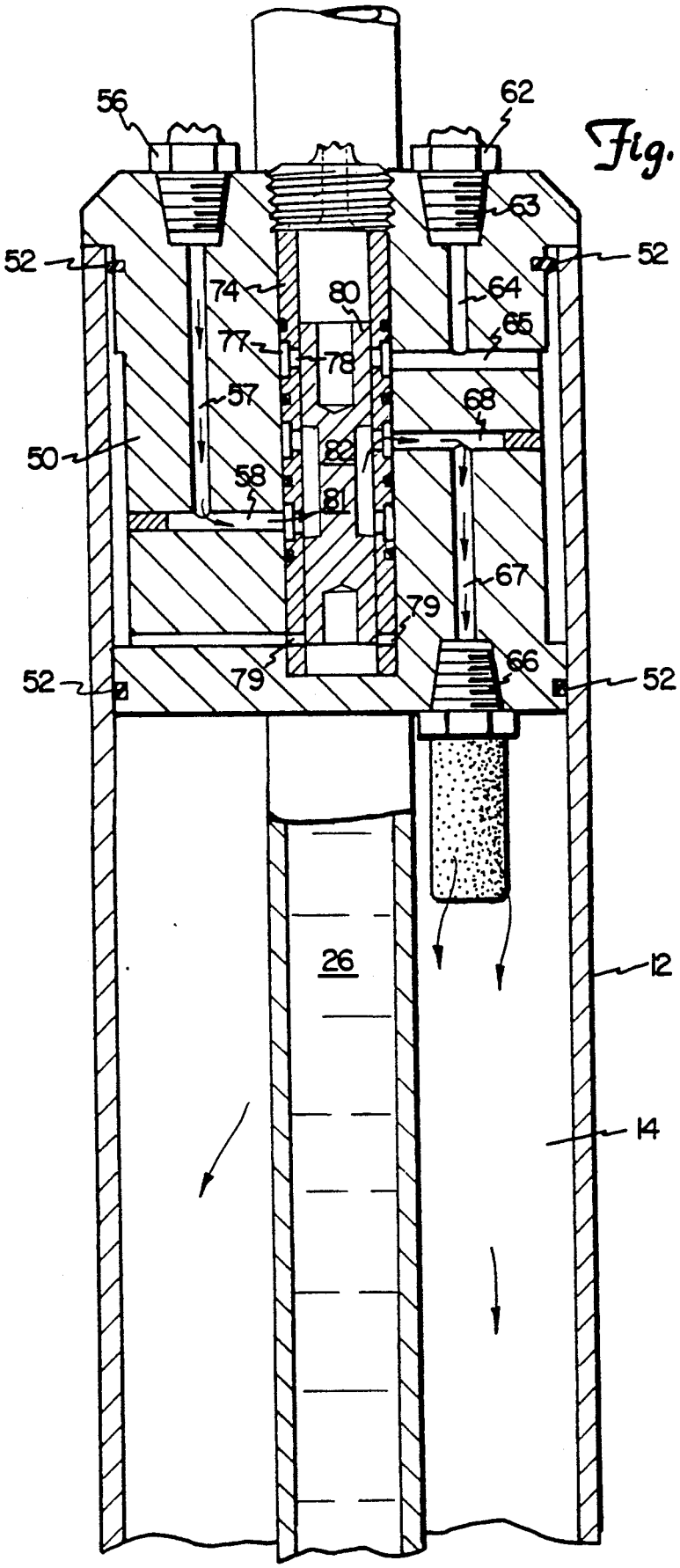
FIG. 4A is a cut-away view of the head and upper portion of the pump cylinder showing the pump in the power phase.
Figure 4B:
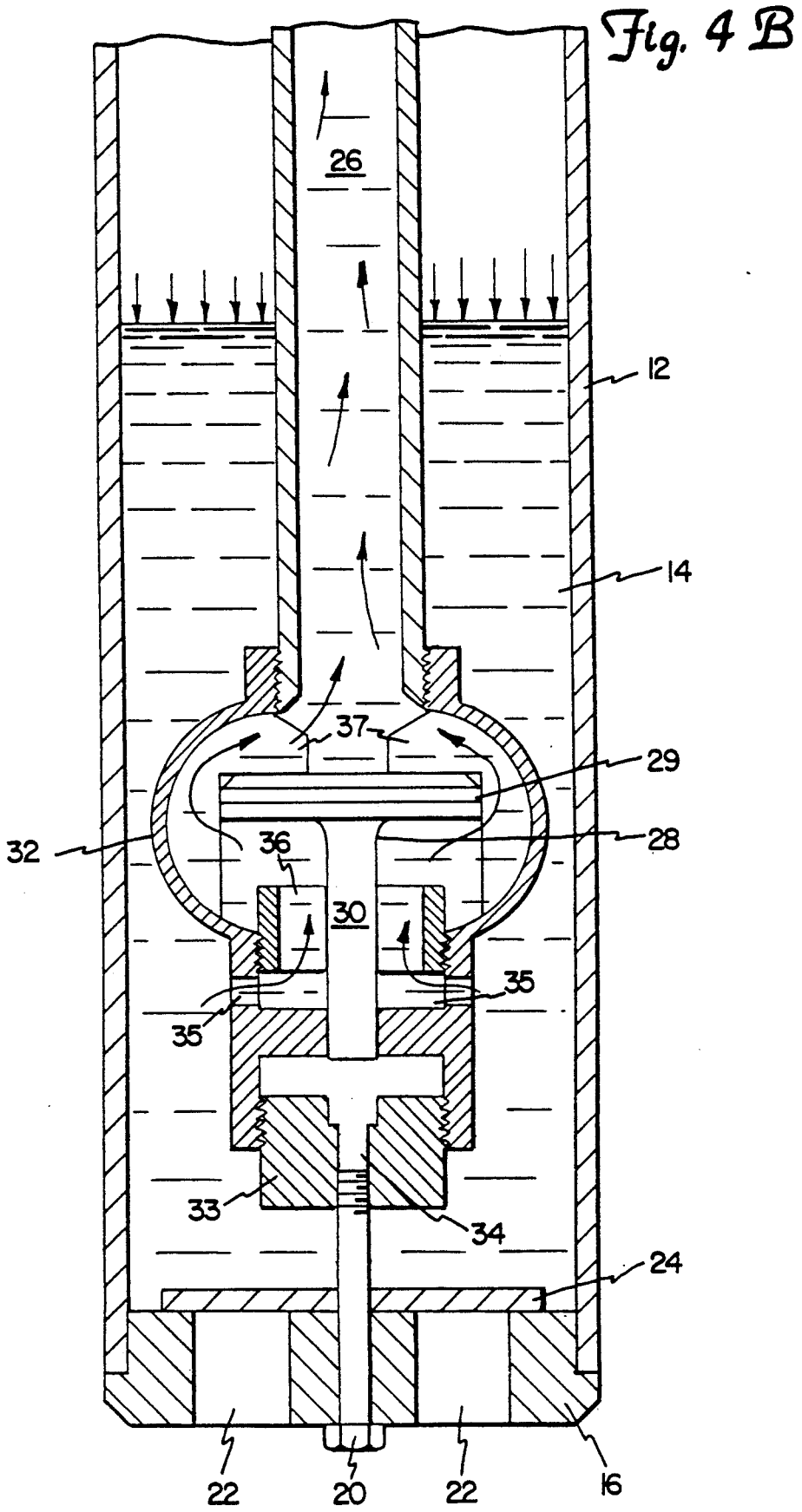
FIG. 4B is a cross-sectional view of the lower portion of the pump cylinder showing the pump in the power phase.
Figure 5A:
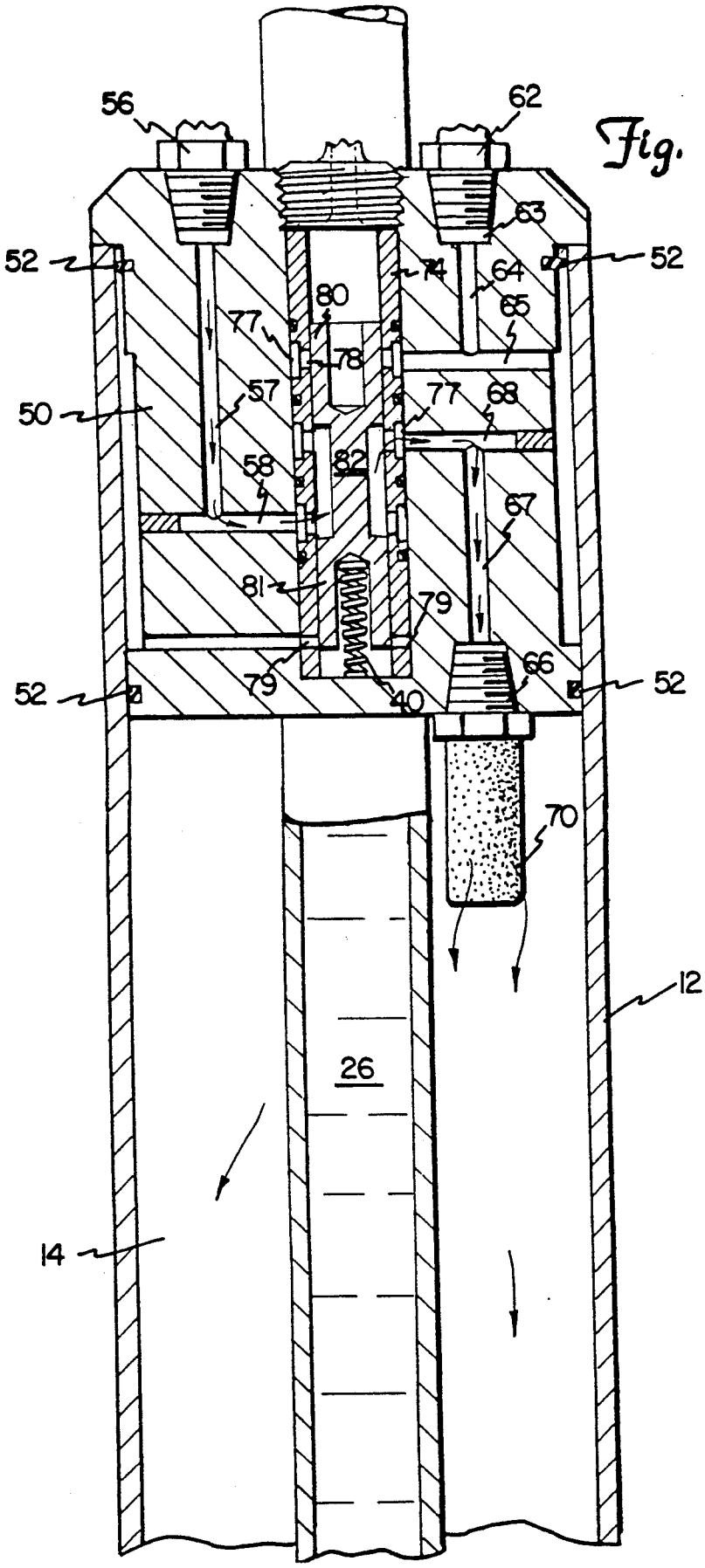
FIG. 5A is a cut-away view of the pump head and upper portion of the pump cylinder showing an alternative embodiment of the spool valve.
Figure 5B:
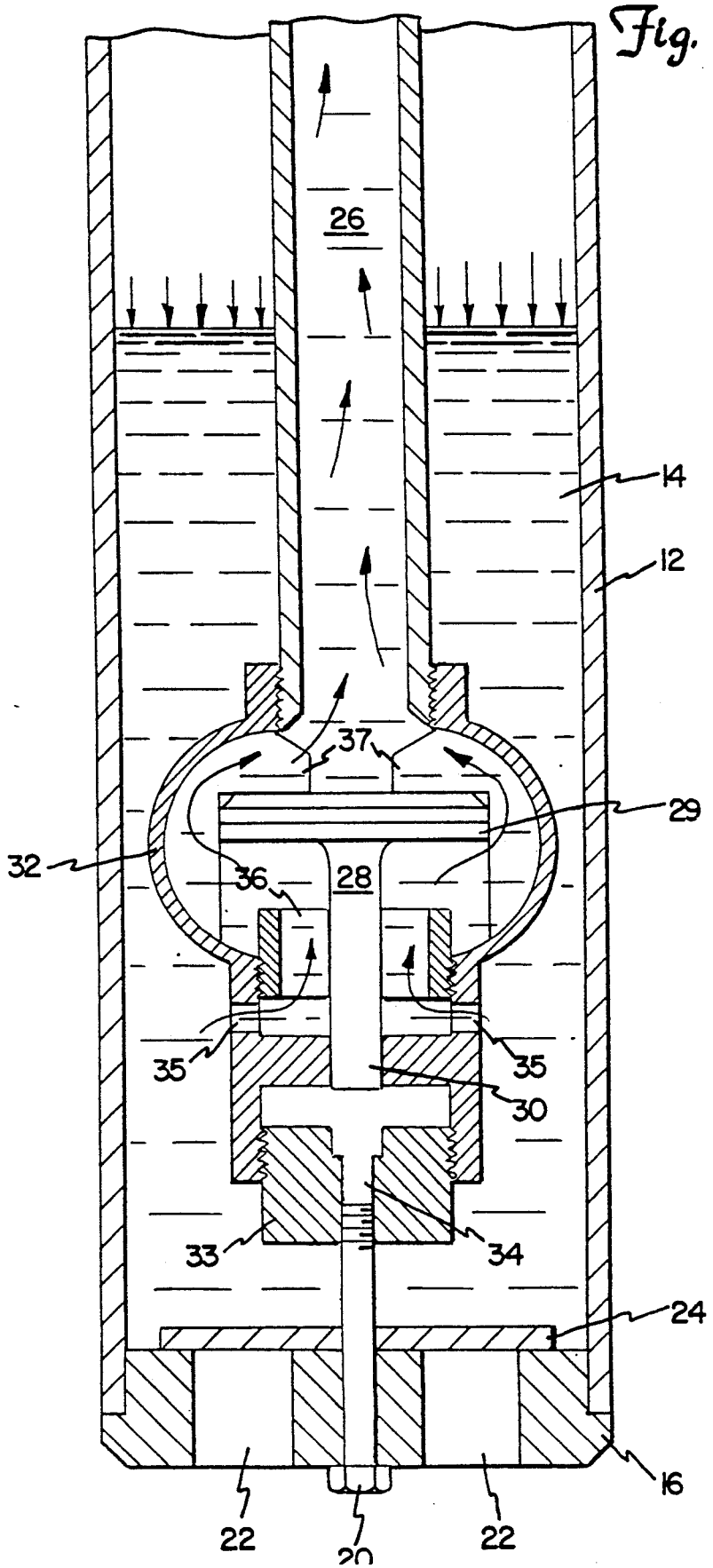
FIG. 5B is a cross-sectional view of the lower portion of the pump cylinder showing the pump in the exhaust position.
Figure 6:
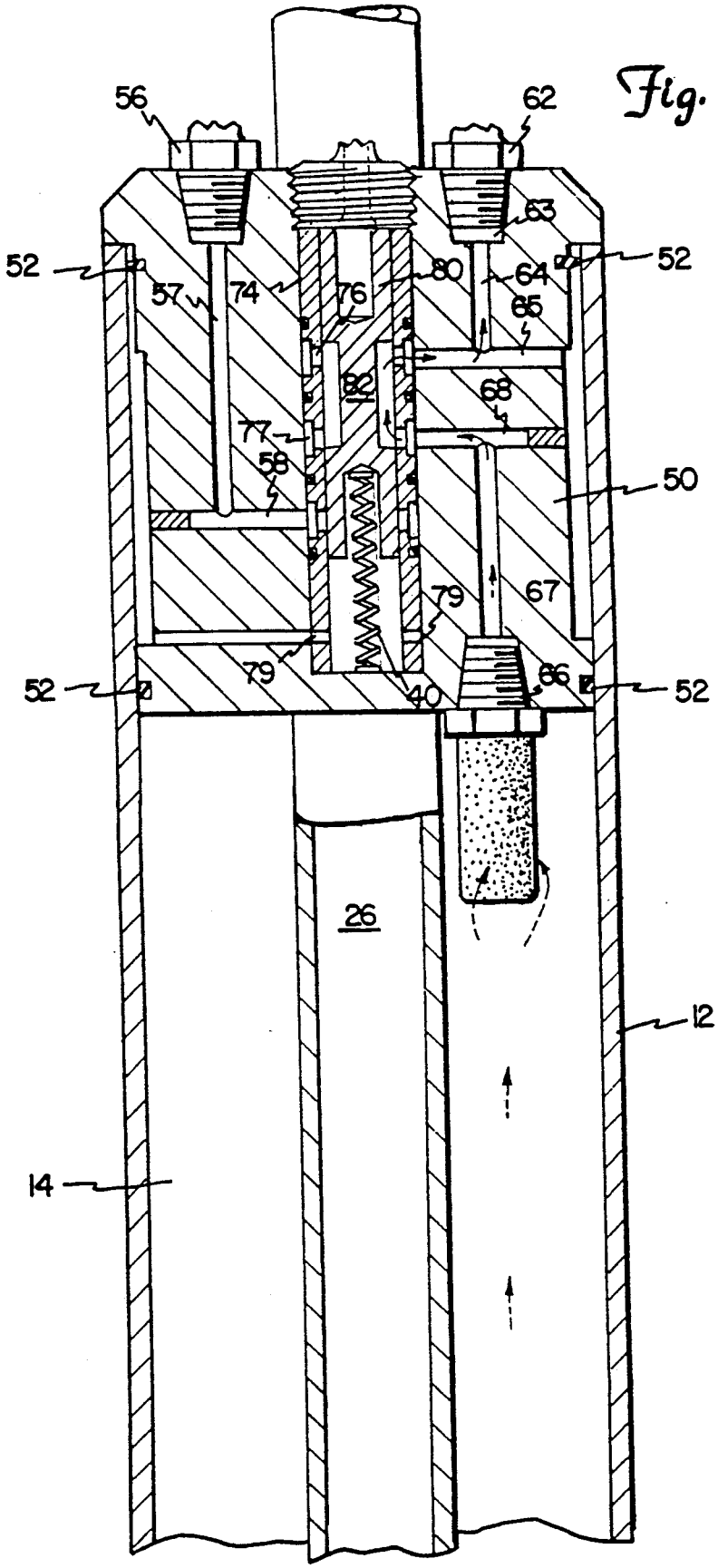
FIG. 6 is a cut-away view of the pump head and upper portion of the pump cylinder showing an alternative embodiment of the spool valve.
Figure 7:
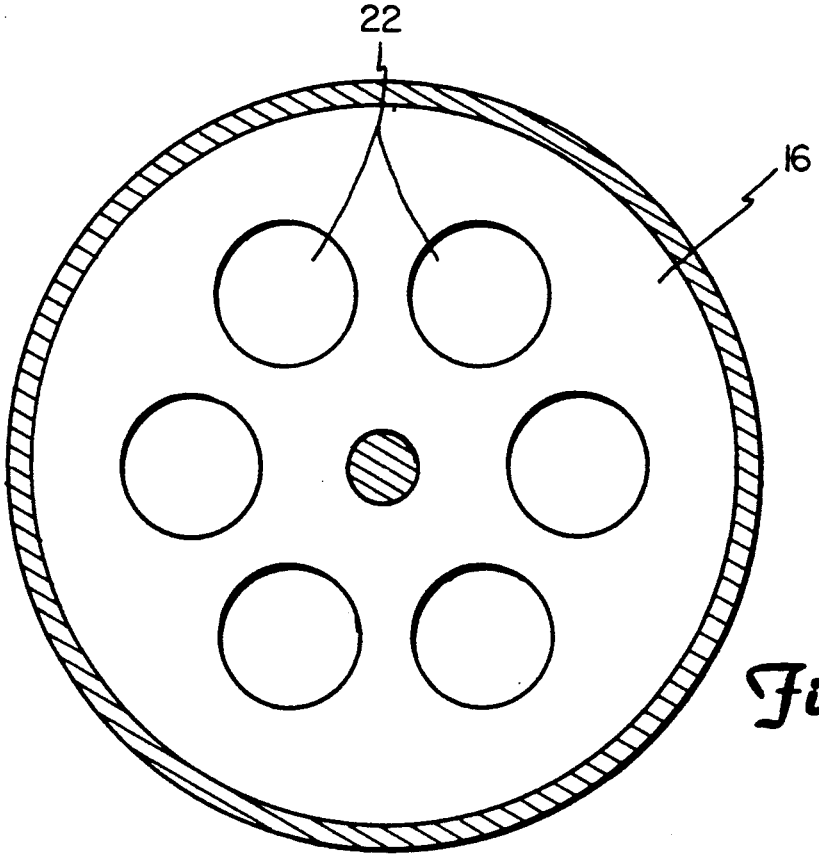
FIG. 7 is a top view of the intake valve.
Figure 8:
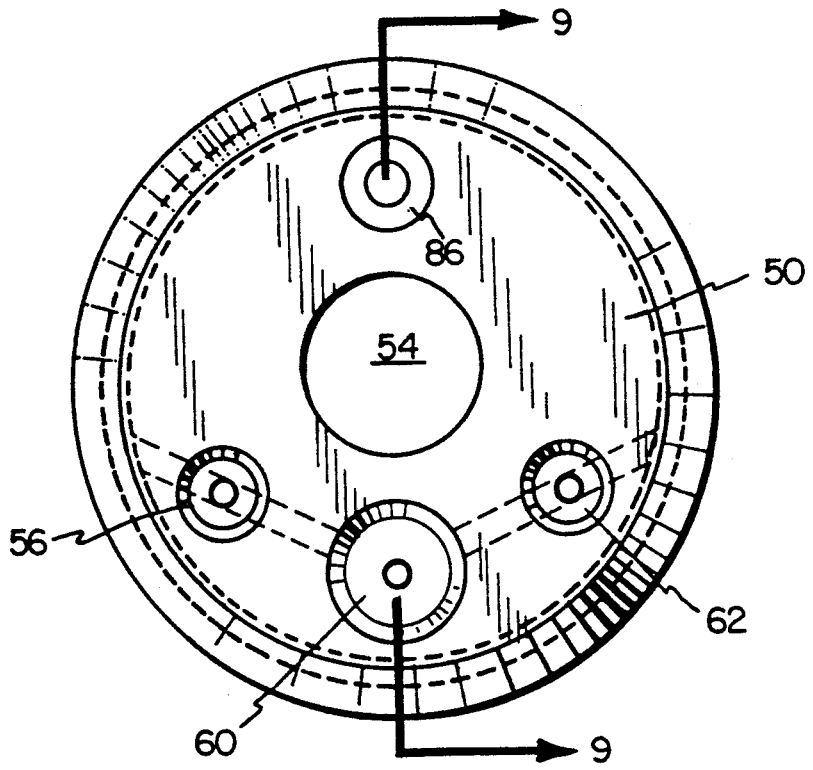
FIG. 8 is a top view of the pump head.
Figure 9:
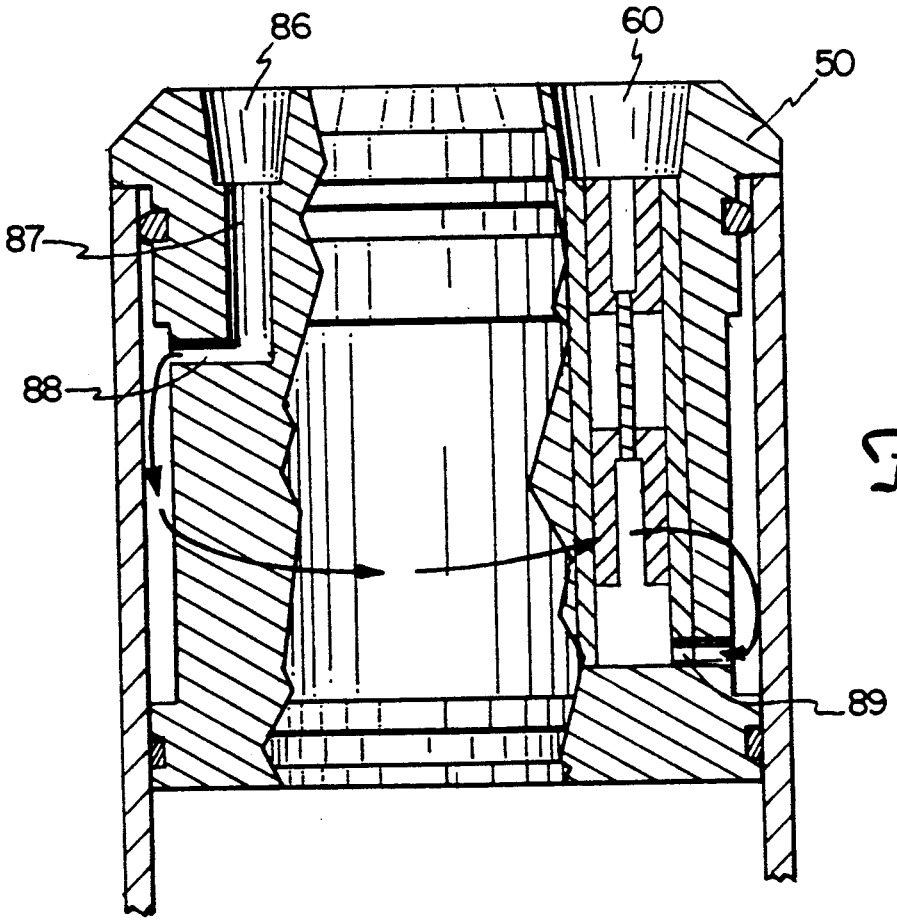
FIG. 9 is a cross-sectional view of the pump head.
Figure 10:
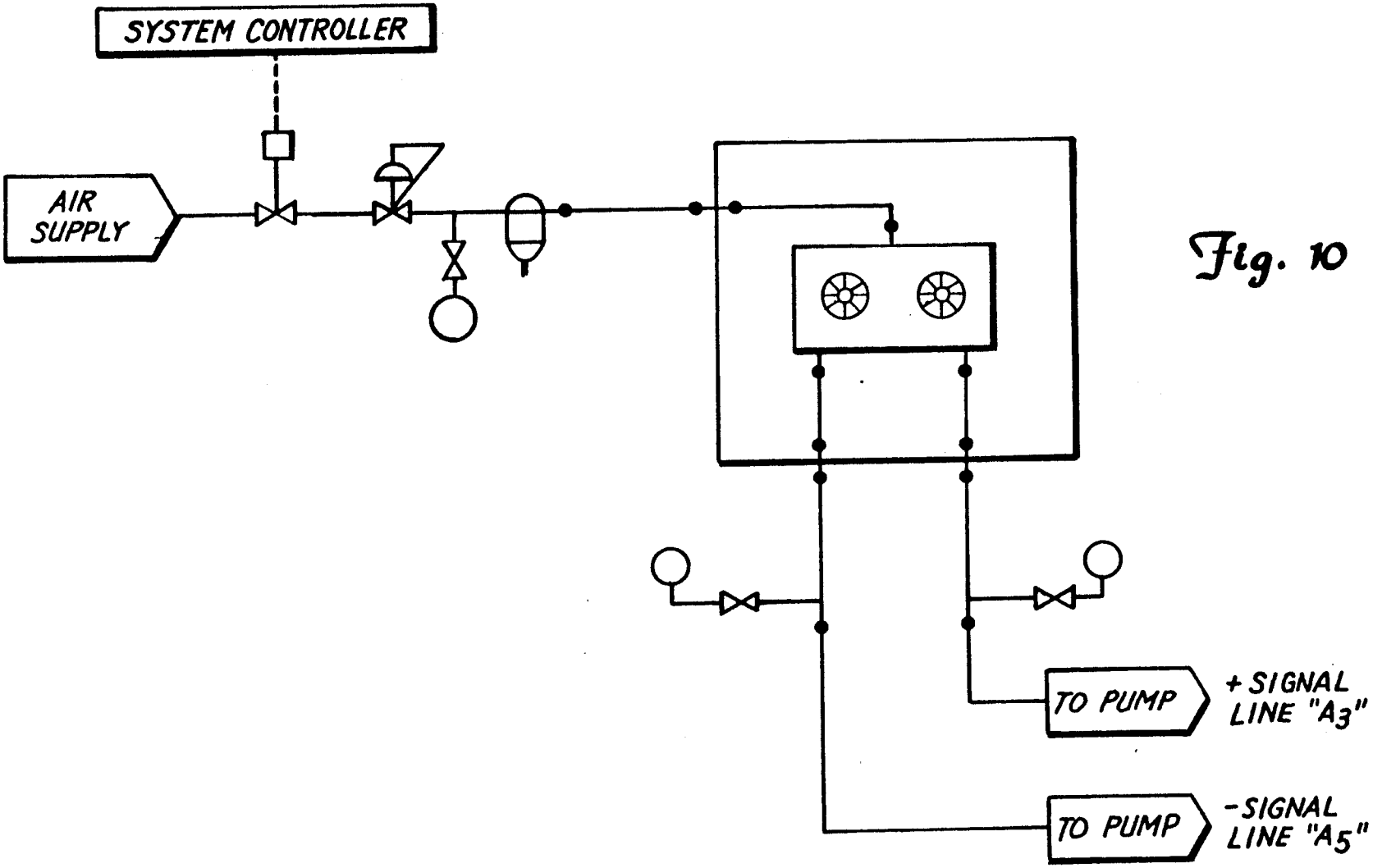
FIG. 10 is a schematic rendering of the pump operation.

The present invention concerns a pneumatic pump generally designated 10 in FIG. 1. The pump includes a body 12 and a head 50. The body 12 has an elongated tubular outer chamber 14 which, in the preferred embodiment, is a hollow cylindrical member. The top end of the chamber 14 is attached to the head 50 and the end of the chamber 14 is closed off with an end cap 16. The end cap 16 is attached to the chamber 14 in a way which prohibits fluid from seeping between them and entering the chamber 14. In the preferred embodiment, an O-ring 18 is used as a seal between the end cap 16 and the base of the chamber 14. Also in the preferred embodiment, an anchor bolt 20 extends longituinally through the center of the end cap 16.

The end cap 16 contains openings to allow fluid to flow into the chamber 14. In the preferred embodiment, six generally circular vents 22 are symetrically spaced around the anchor bolt 20 attached to the end cap 16.

Within the chamber 14 attached to the anchor bolt 20 is a non-return intake valve 24. In the preferred embodiment, the intake valve 24 is generally circular and of sufficient area to completely cover the vents 22. The intake or "Flop" valve 24 allows fluid to pass through the vents 22 into the chamber 14 while preventing fluid from passing through the valve 24 from the chamber 14 in the reverse direction.

Within the chamber 14 is an elongated tubular inner cylinder 26 extending from the head 50 down to the lower portion of the chamber 14. The cylinder 26 is hollow and open at both ends. At the base of the cylinder 26 is attached a non-return outlet valve 28. The outlet or check valve 28 contains a generally circular plate 29 and an axially located shaft 30 extending through the plate 29. The outlet valve 28 allows fluid within the chamber 14 to pass into and up the inner cylinder 26 while preventing the reverse flow of fluid from the cylinder 26 back into the chamber 14. Such non-return or check valves are known in the industry, and in the preferred embodiment, a one inch check valve model number 1F-C63S-FE manufactured by Balon is used.

In the preferred embodiment, the outlet valve 28 is enclosed within a housing 32 attached to the base of the inner cylinder 26. A solid cylindrical plug 33 is inserted into the end of the housing 32 opposite the end attached to the cylinder 26. On the top end of the plug 33 is a collar 34 for receiving the shaft 30 of the outlet valve 28 when the outlet valve 28 is in its closed position. The other end of the plug 33 is drilled and tapped to accept the anchor bolt 20 in the end cap 16.

The housing 32 contains peripheral ports 35 positioned around its outer surface for allowing the fluid to flow from the chamber 14 into the housing 32 at a point below the outlet valve 28. An annular ring 36 encircles the shaft 30 and rests between the ports 35 and the plate 29. When the outlet valve 28 is in its closed position, the plate 29 rests upon the ring 26 thereby blocking the center opened region of the ring 36 and preventing fluid from passing to the cylinder 26. Conversely, when the outlet valve 28 is in its open position, the force of the fluid pushes the plate 29 off the ring 36 thereby allowing the fluid to pass around the plate 29 and into the cylinder 26. The upper movement of the plate 29 is restrained when in its opened position by L-shaped fins 37 circumfrentially located within the housing 32 below the open end of the cylinder 26.

Attached to the top of the chamber 14 is the pump head 50. The dimensions and shape of the head 50 will be configured to correspond to those of the chamber 14. In the preferred embodiment, the head 50 is cylindrically shaped so as to correspond to the body 12. Two O-rings 52 can be located around the top and bottom of the head 50 to act as a seal between the head 50 and the chamber 14.

In the preferred embodiment, left handed threading is added to the head 50 as an aid in positioning the pump within a well and for later recovery of the pump from the well.

In the center of the head is a fluid discharge hole 54. The hole 54 runs the entire longitudinal length of the head 50 and is threaded on both ends. The top of the inner cylinder 26 of the pump body 12 is desirably threadingly attached to the lower end of the fluid discharge hole 54.

Spaced around the fluid discharge hole 54 are four ports. In the preferred embodiment, the top of each port is threaded so as to receive an external conduit. The constant pressure port 56 contains an elongated longitudinal cavity 57 which extends from the top surface of the head 50, into the head 50 and intercepting a lateral cavity 58. This lateral cavity 58 empties into the first signal port 60.

The exhaust port 62 contains an upper section 63 and lower section 66. The upper exhaust section 63 contains an elongated longitudinal cavity 64 extending from the top surface of the head 50 and intersecting a lateral cavity 65. This lateral cavity 65 of the upper exhaust section 63 empties into the first signal port 60. A second lateral exhaust cavity 68, below and parallel with the first lateral exhaust cavity 65 runs from the first signal port 60 to a second longitudinal exhaust cavity 67 which extends to the lower exhaust section 66 at the base cf the head 50. The lower exhaust section 66 opens into the outer chamber 14 of the pump body 12. The lower exhaust section 66 desirably has a filter 70 threadingly attached to it. The filter 70 protects the spool valve 72 described below. The ends of all of the above lateral cavities 58, 65, 68 opposite the first signal port 60 are all plugged so that air passing through them has only a single outlet.

A spool valve 72 is placed within the first signal port 60. This spool valve 72 contains a sleeve 74 and a plunger 76. The sleeve 74 is a tubular annular member which in the preferred embodiment is of a generally circular cross-section and hollow. A plurality of recesses 77 are located around the outside surface of the sleeve 74. In the preferred embodiment, three recesses 77 are used. Paired apertures 78 exist on each recess 77. Each pair of apertures 78 is dimerically opposed to each other. Two smaller apertures 79 are located at the bottom of the sleeve 74. The positions of the apertures 78, 79 are such that when the sleeve 74 is properly placed within the first signal port 60, the apertures 78, 79 line up with the lateral cavities 58, 65, 68.

The plunger 76 consists of two tubular members 80, 81 connected to each other through their longitudinal axis by a support 82. In the preferred embodiment, the two tubular members 80, 81 and the support 82 are all generally circular in cross-section with the diameter of the support 82 being less than that of the tubular members 80, 81.

One end of the plunger 76 has an elongated appendage extending outwardly therefrom. The other end of the plunger 76 may be threadingly attached to a rod (not shown) for use in inserting the plunger 76 into the sleeve 74.

In the preferred embodiment, a plurality of O-rings are used to secure the sleeve 74 to the inside of the first signal port 60. The plunger 76 fits snuggly within the sleeve 74 but is able to axially slide along its longitudinal axis. The outer walls of the tubular members 80, 81 of the plunger 76 are in contact with the interior walls of the sleeve 74 when the plunger 76 is within the sleeve 74.

The second signal port 86 contains a longitudinal cavity 87 that extends from the surface of the head 50 into the head 50 intersecting a lateral cavity 88. This lateral cavity 88 opens to the outer surface of the head 50. A second lateral cavity 89 extends from the outer surface of the head 50 through the head 50 and opens into the lower region of the first signal port 60.

Conduits are desirably attached to the ports in the head 50. One end of a fluid discharge conduit 90 may be attached from the fluid discharge hole 54 to a surface tank for holding the pumped fluid. An exhaust conduit 91 may be attached from the exhaust port 62 and run up to a point above the level of the fluid external of the pump. A constant pressure conduit 92 may be attached from the constant pressure port 56 to a high pressure gas source, compressor or pressurized gas reserve. A first signal conduit 93 may be attached from the first signal port 60 to a first signal outlet 94 on a surface timing controller 95. And finally, a second surface conduit 96 may be attached from the second signal port 86 to a second surface outlet 97 on a surface timing controller 95.

The surface timing controller 95 is a pneumatically operated timing controller as is known in the industry. In the preferred embodiment, the surface timing controller consists of a quarter-inch 0–200 lb gauge model number 47101 manufactured by AMETEK a 200 PSIG filter model number 125221 manufactured by ARO Corporation, a quick exhaust valve model number A212PD manufactured by ARO Corporation, and a 300 PSIG regulator number 73M2CIB000 manufactured by NORRISEAL and a model number 59861 timer manufactured by ARO Corporation enclosed within a Type 3R enclosure manufactured by HOFFMAN.

The pump disclosed is capable of pumping a variety of fluids. As the pumping of oil, however, is a common application for such a pump, the following operation of the pump will be described in terms of the pumping of oil from beneath the earth's surface.

In operation, after the pump is assembled, the conduits that will run from the surface are attached to the ports located on the pump head 50. The conduits are frequently bundled together for convenience. The pump assembly is then submerged desirably below the surface of the oil to be pumped. The pump will typically be maintained in a generally vertical orientation due to the conduits extending from the pump head 50 up to the surface and to their respective sources or outlets.

In one embodiment, a flow of regulated compressed gas from the surface timing controller 95 is sent down the second signal conduit 96 to the head 50 where it enters the top of the second signal port 86. After entering the second signal port 86, the compressed gas exits the second signal port 86 via the first lateral cavity 88. The compressed gas then re-enters the head 50 via the second lateral cavity 89 and travels to the base of the first signal port 60. The compressed gas entering the bottom of the first signal port 60 produces an upward force upon the plunger 76. The plunger 76 slides longitudinally upward within the sleeve 74 until it reaches the top of the first signal port 60 where it is prevented from further upward movement. The position in which the plunger 76 comes to rest at the top of the first signal port 60 is known as the full exhaust position $P_1$. When the plunger 76 is in position $P_1$, the lower tubular member 81 of the plunger 76 blocks the aperture in the recess 77 of the sleeve 74 corresponding to the constant pressure port lateral cavity 58. Correspondingly, the support member 82 of the plunger 76 is perpendicular to the apertures 83 and the recesses 77 of the sleeve 74 corresponding to the upper and lower lateral cavities 65, 68 of the exhaust port 62. Thus, in position $P_1$, the exhaust port 62 is open allowing gases to vent from the outer chamber 14 through the head 50 and to the surface via the exhaust conduit 91.

The relative positive hydrostatic pressure of the oil surrounding the pump is sufficient to overcome the atmospheric pressure now existing within the outer chamber 14 causing the intake flop valve 24 to open exposing the vents 22 in the end cap 16. Oil then enters the outer chamber 14 through the vents 22.

At an interval preset by the operator, the surface timing controller 95 ceases sending compressed gas to the second signal port 86 and begins sending a flow of regulated compressed gas down the first signal conduit 93 to the head 50 where it enters the top of the first signal port 60. The lack of compressed gas in the base of the first signal port 60 in conjuncture with the compressed gas now being supplied to the top of the signal port 60 causes the plunger 76 to descend within the sleeve 74. The plunger 76 stops its descent upon reaching the base of the first signal port 60. The plunger 76 is now in its full power position $P_2$. In position $P_2$, the upper tubular member 80 of the plunger 76 blocks the aperture 83 in the recess 77 of the sleeve 74 corresponding to the upper latitudinal cavity 65 of the exhaust port 62. The lower latitudinal cavity 68 as well as the constant pressure latitudinal cavity 58 of the constant pressure port 56 is now exposed. The supply of constant pressure sent from a surface compressor to the constant pressure port 56 is allowed to flow through the first signal port 60 into the lower section 66 of the exhaust port 62 and into the outer chamber 14.

The positive force of the compressed gas on the surface of the oil occupying the outer chamber 14 causes the relative pressure balance to shift creating a greater combined interior pressure than the hydrostratic pressure. This shift in relative pressure forces the intake flop valve 24 against the end cap 16 thereby closing the vents 22 and preventing the oil from exiting the outer chamber 14 via the vents 22.

The force of the compressed gas upon the oil causes the oil to flow through the ports 35 within the housing 32 and opening the outlet valve 28 at the base of the inner cylinder 26. The oil then flows up the inner cylinder 26 through the fluid discharge hole 54 within the head 50 and through the fluid discharge conduit 90 to the surface. The inner cylinder 26 vents freely to the surface and thus only exerts the force of the weight of the column of oil contained within the fluid discharge conduit 90.

As the oil is forced through the outlet valve 28 and into the inner cylinder 26 the volume once occupied by the oil in the outer chamber 14 is replaced with compressed gas.

At another predetermined time set by the operator of the pump, the surface timing controller 95 cuts off the supply of compressed gas to the top of the first signal port 60 and re-establishes the flow of compressed gas to the second signal port 86. The plunger 76 is repositioned to $P_1$ and the air within the outer chamber 14 is again vented to the surface through the exhaust port 62. The oil that remains within the fluid discharge conduit 90 and the inner cylinder 26 is prevented from re-entering the outer chamber 14 by the outlet check valve 28. These two part cycles controlled by the surface timing controller 95 are repeated until such time as the signal timing cycle system is ended.

In an alternate embodiment, the second signal port 86 is plugged and a spring 40 is located at the base of the first signal port 60. The appendage 83 of the plunger 76 rests within the top of the spring 40. When the pump is first submerged within the oil, the spring 40 is uncompressed and the plunger 76 is in the full exhaust position $P_1$. When the full power cycle begins, the compressed gas entering the top of the first signal port 60 produces a downward force upon the plunger 76. The plunger 76 slides longitudinally within the sleeve 74 in a downward direction thereby compressing the spring 40. When the spring 40 reaches it maximum compression, the plunger 76 comes to rest. This position is the full power position $P_2$.

In another embodiment, a closed charged gas recovery system is provided for recycling the pressurized gas utilizing a scrubber and vapor return system to recover the hydrocarbons present in the compressed gas.

In another embodiment, the continual volume of gas present in the constant pressure port acts as a reservoir to moderate the demand between the first and second signal ports. This allows the pumps to be "ganged" or operated by the same gas supply in either a manual or automatic mode from the surface controls.

The pump components may be constructed from a variety of materials chosen to withstand the physical, chemical or other properties of the fluids to be pumped or the atmosphere in which the fluids are found. In the preferred embodiment, the pump chambers, head and most other components are constructed of stainless steel. The nonreturned valves and conduits can be made of a noncorrosive plastic or composite material as desired. The depth limitation for the pumping system is regulated by the pressure capacity of the materials the pump is constructed from and the available gas pressure's ability to lift the column of fluid.

While a preferred embodiment of the present invention has been described, it should be understood that various changes, adaptations and modifications may be made therein without departing from the spirit of the invention and the scope of the appended claims.

What is claimed is:

1. A pneumatic pump for pumping fluids, comprising:

an elongate tubular body;

a first port for allowing the admission of the fluid;

a second port for allowing the discharging of the fluid;

a compressed gas source;

conduit means for conveying the compressed gas to the body;

a head located at the top of the body;

a check valve positioned over the first port for regulating the admission of fluid into the pump;

a flop valve for regulating the discharge of the fluid from the pump;

a sleeve carried in the head; and a plunger slidably located within the sleeve for regulating the communication of the compressed gas to the body by moving between a first position whereby the pump filling phase is achieved and a second position whereby the pumping phase is achieved, the plunger being moved into the first position by introducing the compressed gas into the lower portion of the sleeve and being moved into the second position by introducing the compressed gas into the upper portion of the sleeve.

2. A pneumatic pump for pumping fluids, comprising:

an elongate tubular body;

a head located at the top of the body;

a first port for allowing the admission of the fluid;

a second port for allowing the discharging of the fluid;

a check valve positioned over the first port for regulating the admission of fluid into the pump;

a flop valve for regulating the discharge of the fluid from the pump;

a compressed gas source;

conduit means for conveying the compressed gas to the body; and a sleeve and a plunger slidably located within the sleeve, the sleeve being carried in the head for selectively alternatively communicating the compressed gas to the body to expel the fluid therefrom during a first pumping phase and for permitting the escape of the gas therefrom during a second pump filling phase, whereby the plunger regulates the communication of the compressed gas to the body by moving between a first position whereby the pump filling phase is achieved and a second position whereby the pumping phase is achieved, the plunger being moved to the first position by introducing compressed gas into the lower portion of the sleeve and being moved to the second position by introducing compressed gas into the upper portion of the sleeve.

* * * * *